US009702512B2

(12) United States Patent
Power et al.

(10) Patent No.: US 9,702,512 B2
(45) Date of Patent: Jul. 11, 2017

(54) SOLID-STATE LAMP WITH ANGULAR DISTRIBUTION OPTIC

(71) Applicant: CREE, INC., Durham, NC (US)

(72) Inventors: David Power, Morrisville, NC (US); Jeremy Johnson, Fuquay Varina, NC (US)

(73) Assignee: Cree, Inc., Durham, NC (US)

( * ) Notice: Subject to any disclaimer, the term of this patent is extended or adjusted under 35 U.S.C. 154(b) by 109 days.

(21) Appl. No.: 14/657,062

(22) Filed: Mar. 13, 2015

(65) Prior Publication Data

US 2016/0265728 A1 Sep. 15, 2016

(51) Int. Cl.
*F21K 99/00* (2016.01)
*F21K 9/90* (2016.01)
(Continued)

(52) U.S. Cl.
CPC ..... *F21K 9/50* (2013.01); *F21K 9/135* (2013.01); *F21K 9/23* (2016.08); *F21K 9/61* (2016.08); *F21K 9/90* (2013.01); *F21V 23/02* (2013.01); *F21V 29/50* (2015.01); *F21Y 2101/02* (2013.01); *F21Y 2115/10* (2016.08)

(58) Field of Classification Search
CPC ..... F21K 9/50; F21K 9/61; F21K 9/23; F21K 9/135; F21K 9/90; F21K 9/60; F21K 9/00; F21K 99/00; F21V 29/50; F21V 23/02; F21V 19/042; F21V 19/045; F21V 2200/00; F21V 2200/15; F21Y 2101/00;
(Continued)

(56) References Cited

U.S. PATENT DOCUMENTS 3,581,162 A 5/1971 Wheatley
5,463,280 A 10/1995 Johnson
(Continued)

FOREIGN PATENT DOCUMENTS

EP 0890059 A1 1/1999
EP 1058221 A2 12/2000
(Continued)

OTHER PUBLICATIONS

Trade Show Hand-out, "Looking for Partner," 20 pages.
(Continued)

*Primary Examiner* — Bao Q Truong
(74) *Attorney, Agent, or Firm* — Moore & Van Allen

(57) ABSTRACT

A solid-state lamp with an angular distribution optic is disclosed. Embodiments of the present invention can provide for improved luminous intensity distribution in the vertical plane for a vertically oriented solid-state lamp. A lamp according to some example embodiments of the invention includes at least one LED, an optically transmissive enclosure for the LED or LEDs, and a base. The lamp also includes a distribution optic conformably disposed in or on the base to conduct light for angularly distributed emission from the base of the lamp. In some embodiments, the lamp is dimensioned as a replacement for a candelabra type incandescent bulb. The distribution optic can be composed of any optical medium, and in some embodiments, may be from about 1 mm to about 5 mm thick. In some embodiments, the distribution optic is made of thermally conductive plastic.

31 Claims, 7 Drawing Sheets

(51) Int. Cl.

| | |
|---|---|
| ***F21V 23/02*** | (2006.01) |
| ***F21V 29/50*** | (2015.01) |
| ***F21K 9/23*** | (2016.01) |
| ***F21K 9/61*** | (2016.01) |
| *F21Y 101/02* | (2006.01) |
| *F21Y 115/10* | (2016.01) |

(58) Field of Classification Search
CPC ..... F21Y 2101/02; F21S 2/00; G02B 6/001; G02B 6/0001
See application file for complete search history.

(56) References Cited

U.S. PATENT DOCUMENTS

| | | | |
|---|---|---|---|
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Börner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,249 | B2 | 10/2012 | Liang et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,421,329 | B2 | 4/2013 | Liang et al. |
| 8,427,037 | B2 | 4/2013 | Liang et al. |
| 8,449,154 | B2 | 5/2013 | Uemoto et al. |
| 8,502,468 | B2 | 8/2013 | Li et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 8,866,385 | B2 * | 10/2014 | Kitagawa ..... F21V 17/101 313/318.01 |
| 2004/0201990 | A1 | 10/2004 | Meyer |
| 2009/0184618 | A1 | 7/2009 | Hakata et al. |
| 2012/0040585 | A1 | 2/2012 | Huang |
| 2013/0335966 | A1 * | 12/2013 | Yokota ..... F21K 9/52 362/235 |
| 2014/0293654 | A1 | 10/2014 | Kato et al. |
| 2015/0085492 | A1 | 3/2015 | Kato et al. |

FOREIGN PATENT DOCUMENTS

| | | | |
|---|---|---|---|
| EP | 2385400 | A2 | 9/2011 |
| EP | 2789893 | A1 | 10/2014 |
| GB | 2345954 | A | 7/2000 |
| JP | 09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |
| WO | 2013086694 | A1 | 6/2013 |

OTHER PUBLICATIONS

Cree, Inc., International Patent Application No. PCT/US2016/020581, International Search Report and Written Opinion, May 31, 2016.

* cited by examiner

SOLID-STATE LAMP WITH ANGULAR DISTRIBUTION OPTIC

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and/or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is often needed to cool the LEDs and/or power supply in order to maintain appropriate operating temperature.

SUMMARY

Embodiments of the present invention can provide for improved luminous intensity distribution in the vertical plane for a vertically oriented solid-state lamp with a power supply or driver in the base. In some locales, government, non-profit and/or educational entities have established standards for SSL products, and luminous intensity distribution is typically part of such standards. LED bulbs typically include electronic circuitry and in some cases, a heat sink, which may obstruct the light in the direction of a base with the power supply. Embodiments of the present invention can provide for better angular emission of light from the base of such a solid-state lamp or bulb.

A lamp according to some example embodiments of the invention includes at least one LED, an optically transmissive enclosure for the LED or LEDs, and a base. The lamp also includes a distribution optic conformably disposed in or on the base to conduct light from the at least one LED for angularly distributed emission from the base of the lamp. Such an optic may be referred to herein as a distribution optic or an angular distribution optic. In some embodiments the lamp also includes a guide optic arranged to direct light from the LED(s) into the distribution optic. The guide optic can be transmissively coupled to the distribution optic to direct the light. The optically transmissive enclosure can alternatively or additionally be transmissively coupled to the distribution optic to direct light into the distribution optic.

In some embodiments, a power supply, sometimes referred to as a "driver" resides in the base. Hence, the base may be referred to as a "driver base." In some embodiments, a reflective insert is included in or on the base between the distribution optic and the power supply. In some embodiments, the lamp is dimensioned as a replacement for a candelabra type incandescent bulb. In some embodiments, the lamp is dimensioned as a replacement for an A-series incandescent bulb. A lamp according to example embodiments can be assembled by assembling a power supply within the base of the LED lamp, connecting at least one LED to the power supply, connecting an optically transmissive enclosure to the base of the LED lamp to enclose the at least one LED, and installing a distribution optic in or on the base so as to serve as a light pipe by conducting light from the at least one LED for angularly distributed emission from the base of the LED lamp.

In some embodiments, the distribution optic is plastic, which can be translucent or transparent, and can be thermally conductive to aid in cooling the driver of a lamp. The distribution optic can be any optical medium, and in some embodiments, may be from about 1 mm to about 5 mm thick. In some embodiments, the thermal conductivity of the optical medium may be realized through the use of a thermally conductive additive. In some embodiments, a guide optic may be a total-internal reflection (TIR) optic that serves both to direct light from the LED(s) into the distribution optic or optical medium, and to direct light into the interior of the optically transmissive enclosure.

In some embodiments of the invention, an LED candelabra lamp includes a driver base and an optical dome connected to the driver base. When viewed at a distance, the LED candelabra lamp gives of light in substantially all directions in the vertical plane, from both the optical dome and the driver base, to give the appearance of a traditional, incandescent candelabra bulb. The optical dome and the driver base can be made as distinct components, or they can be molded, extruded, or otherwise made together as one piece.

Embodiments of the invention can be especially useful in SSL bulbs dimensioned to replace elongated incandescent bulbs where the width of the top of the optical dome is equal to or narrower than the width of the base, such as candelabra bulbs. However, embodiments of the invention can be used in solid-state lamps of any shape.

DETAILED DESCRIPTION

Figure 1:
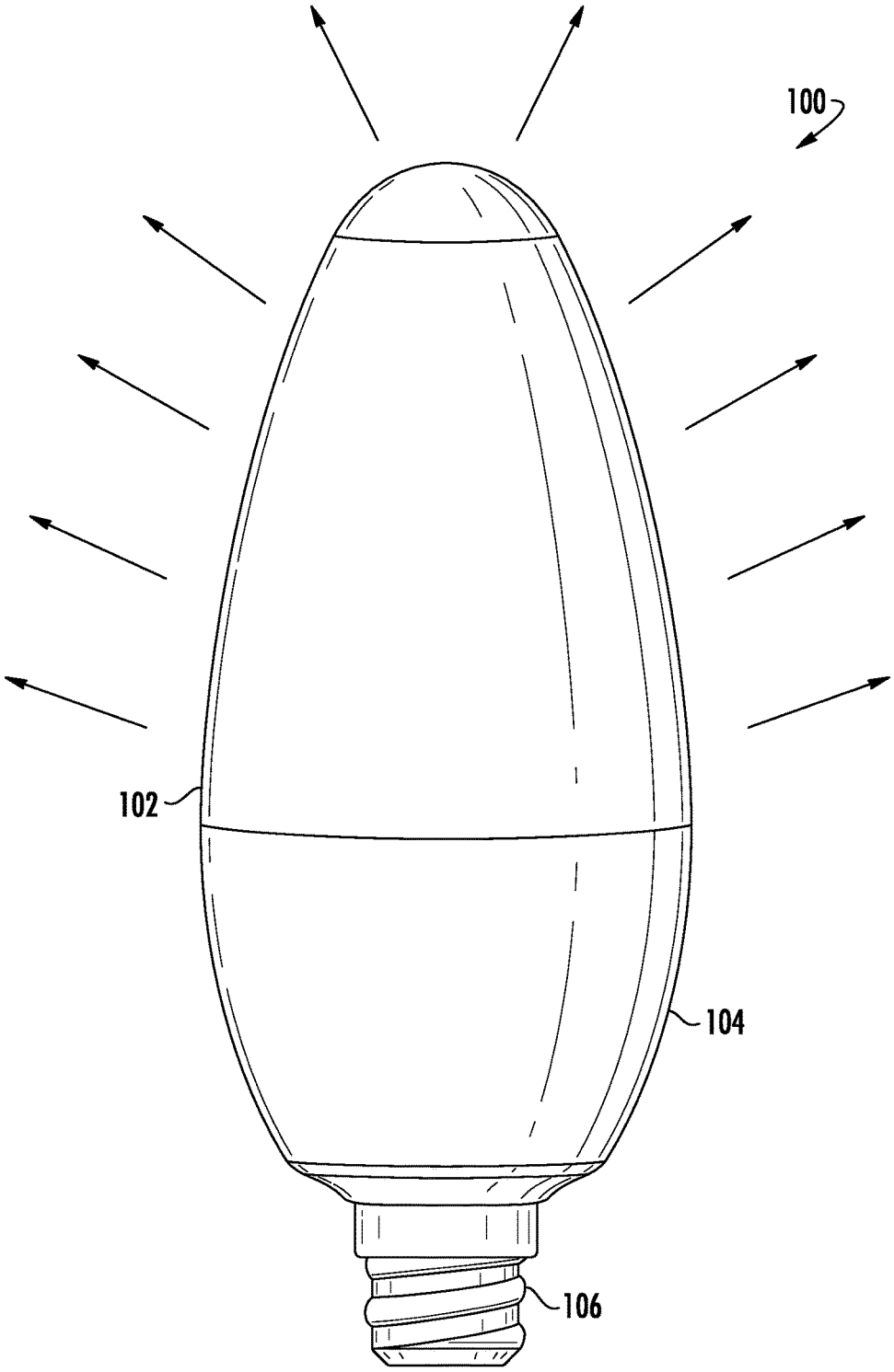
FIG. 1 (BACKGROUND ART)
FIG. 1 is a side view of a solid-state "candelabra" style lamp as is known in the art, wherein the light pattern produced by the lamp is indicated.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising." "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid-state light emitter" or "solid-state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid-state light emitters and/or multiple lumiphoric materials (i.e., in combination with at least one solid-state light emitter) may be used in a single device, such as to produce light perceived as white or near-white in character. In certain embodiments, the aggregated output of multiple solid-state light emitters and/or lumiphoric materials may generate warm white light output having a color temperature range of from about 2700K to about 4000K.

Solid-state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid-state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid-state emitter.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

Example embodiments of the present invention provide for improved luminous intensity distribution in the vertical plane for a vertically oriented solid-state lamp with a power supply or driver in the base. The phrase, "vertically oriented" is used for reference only. The lamp according to example embodiments of the invention can be oriented in any direction and the advantages discussed herein will be equally realized. As previously mentioned, an embodiment of the invention can find use in a lamp of any form factor or shape; however, embodiments of the invention can be especially useful in SSL bulbs dimensioned to replace elongated incandescent bulbs where the width of the top of the optical dome is equal to or narrower than the width of the base, such as candelabra bulbs. FIG. 1 illustrates an LED candelabra lamp/bulb 100 as is known in the art. Bulb 100 includes an optical enclosure 102 covering the LEDs, an opaque driver base 104, and an Edison-style screw connector 106. The arrows emanating from the bulb indicate the emission of light. Note that since driver base 104 is opaque and includes the power supply, no light emanates from that part of the bulb. Thus, when viewed at a distance, LED lamp 100 does not give off light in all directions and looks quite different than a traditional incandescent candelabra bulb.

Figure 2:
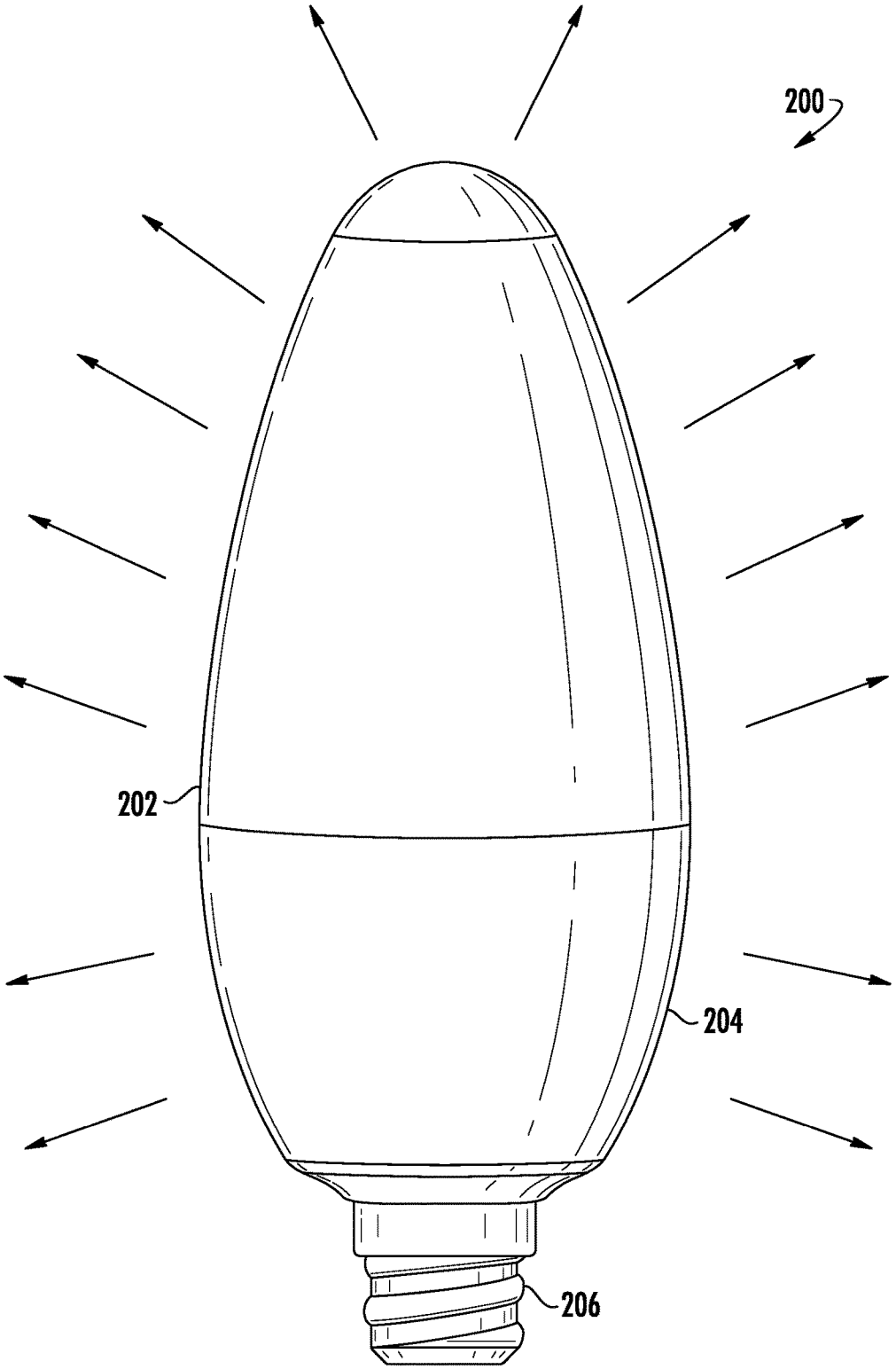
FIG. 2 is a side view of a solid-state candelabra style lamp according to embodiments of the invention, where the light pattern produced is indicated.

FIGS. 2, 3, 4, and 5 show various views of an LED replacement bulb or lamp 200 according to example embodiments of the invention. FIG. 2 is a schematic side view of lamp 200. Lamp 200 is dimensioned as a replacement for a candelabra-style incandescent bulb and includes optically transmissive enclosure 202, driver base 204 and an Edison-type screw connector 206. Driver base 204 includes a power supply to provide the correct voltage and current to drive the LEI) or LEDs that serve as light sources for solid-state bulb 200, receiving line voltage as input through the Edison-type screw connection. It should be noted that any type of electrical connection could be used in a solid-state replacement bulb according to example embodiments of the present invention. The arrows emanating from the bulb indicate the emission of light. Note that in the case of bulb 200, light is emitted from driver base 204 along with the light from the optically transmissive enclosure 202. Thus, bulb 200 can be said to include a driver base and an optical dome connected to the driver base, where, when viewed at a distance, the LED lamp gives off light in substantially all directions in the vertical plane, and thus looks like a traditional incandescent candelabra bulb. It should be noted that the optical dome and the driver base can be made as distinct parts or components, or they can be molded, extruded, or otherwise made together as one piece.

Figure 3:
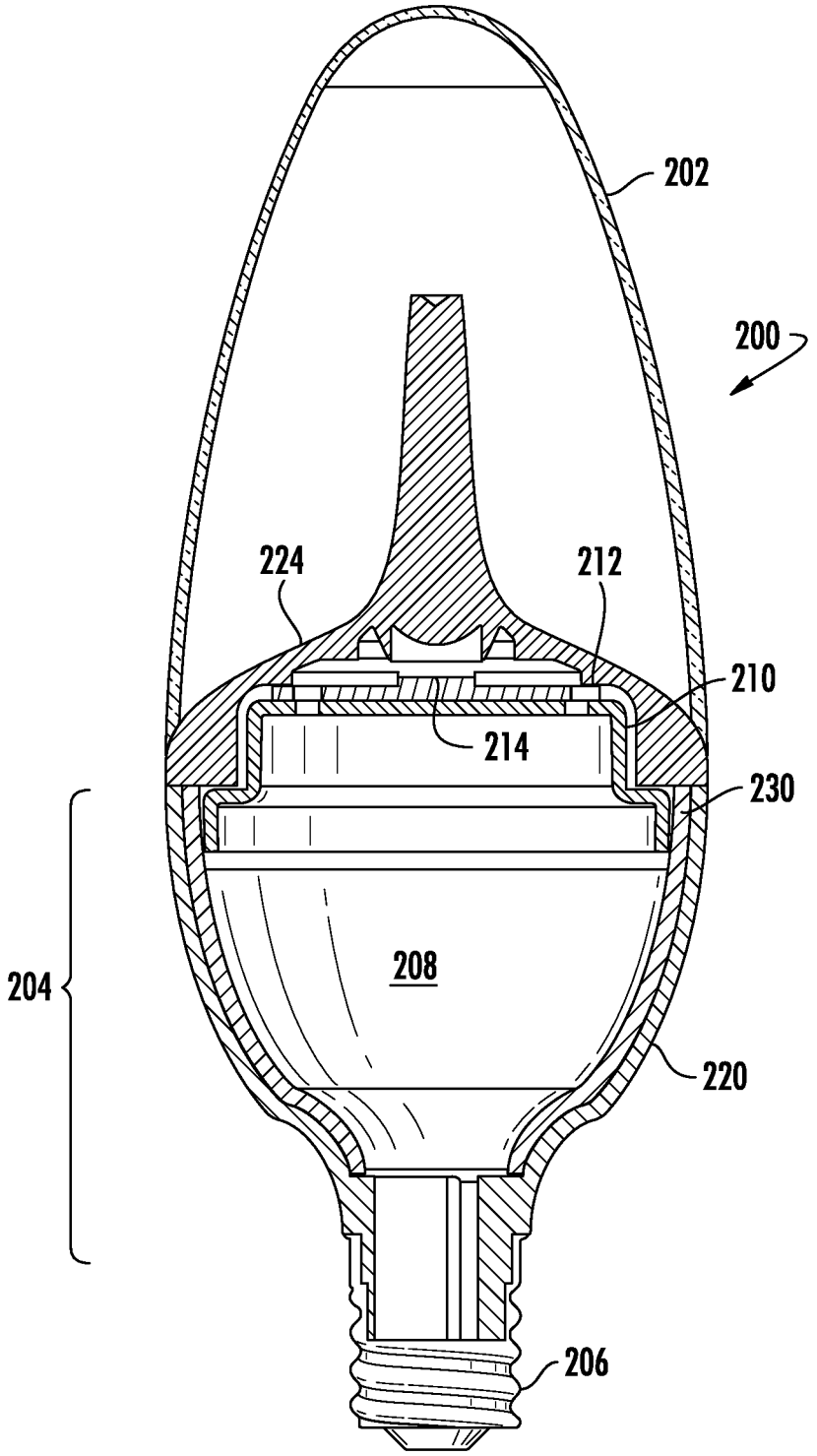
FIG. 3 is a cut-away side view of the solid-state candelabra lamp of FIG. 2 in which some of the internal components are visible.

FIG. 3 is a view of solid-state bulb 200 with all the parts of the bulb cut away and the power supply components removed from power supply shell 208. The base of bulb 200 as visible in FIG. 3 and FIG. 4 includes support 210 and circuit board 212, on which an LED device package 214 is mounted. Bulb 200 includes an angular distribution optic 220 conformably disposed in or on the base. This distribution optic can be translucent or transparent, and can be formed from an optical medium such as rigid plastic or a material that is sprayed, molded in place, or otherwise similarly applied to the base. In example embodiments the optical medium, regardless of the material can be on average, from 1 mm to 5 mm thick, and is conforming to the general shape of the base.

Figure 4:
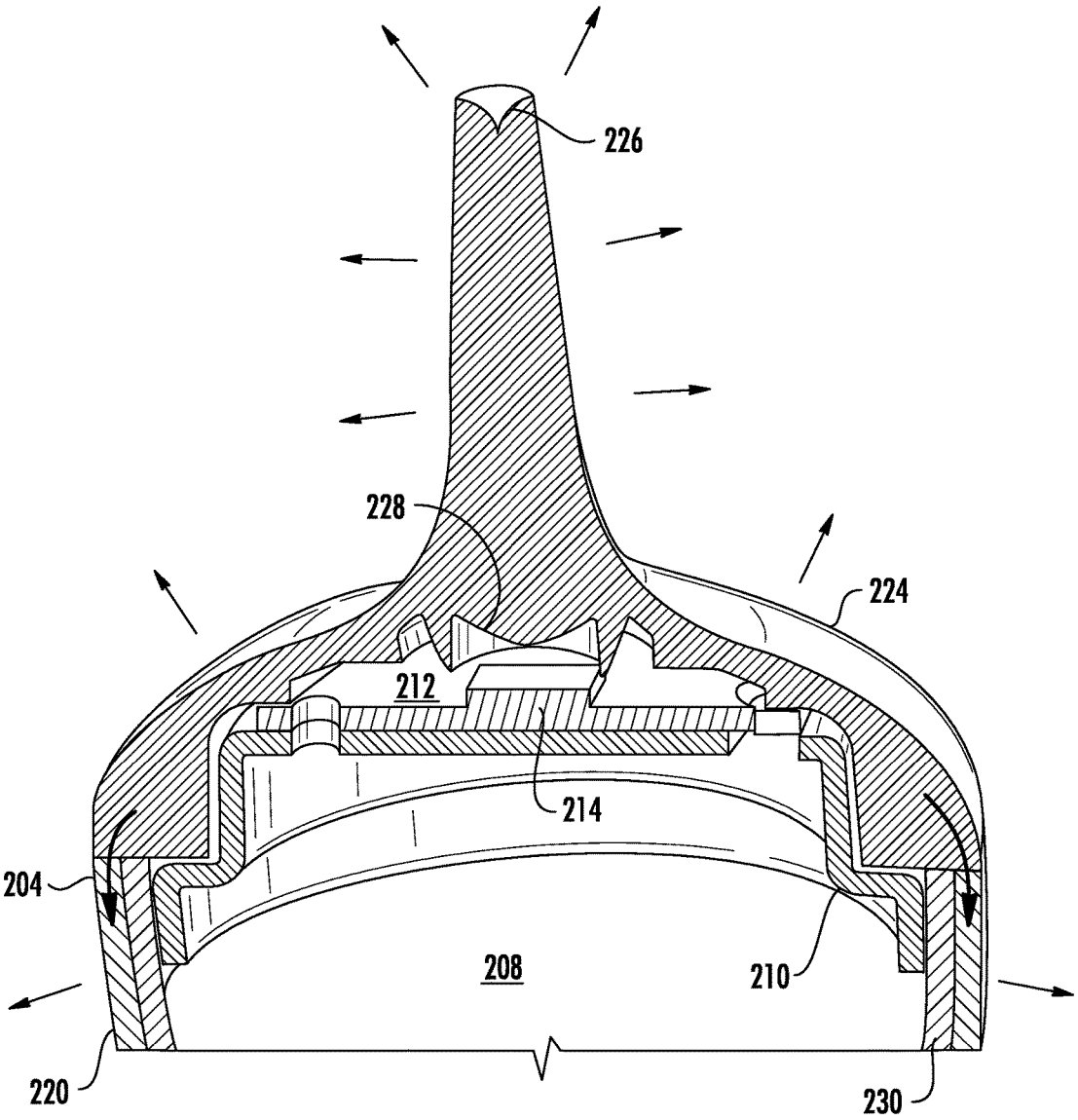
FIG. 4 is an enlarged cut-away, perspective view of the base of the candelabra lamp of FIGS. 2 and 3 with the optical dome removed according to example embodiments of the invention.

Still referring to FIG. 3 and FIG. 4, lamp 200 also includes a guide optic 224 transmissively coupled to the distribution optic and arranged to direct light from the LED device package into the distribution optic, as indicated by the arrows from the guide optic to the distribution optic shown in FIG. 4. The guide optic also directs light into the optically transmissive dome enclosure 202. Light then emanates from the distribution optic around the base of the bulb, in addition to from the top portion of the guide optic and out through optically transmissive enclosure 202, resulting in a natural, pleasing light pattern, especially for a candelabra bulb, which may be installed in an open or transparent fixture.

Guide optic 224 in this example embodiment is a total-internal-reflection (TIR) optic. The vertical part of guide optic 224 in this example embodiment is tapered, and includes internally reflective surfaces 226 at the top end. Entry surface 228 directs light rays as appropriate to exit the optic at the top and sides to direct light into optically transmissive enclosure 202 and eventually emanate from the top portion of the bulb.

Continuing with FIG. 3 and FIG. 4, a reflective insert 230 in this example is installed between the distribution optic and the power supply. In some embodiments this insert is made of aluminum; however other materials could be used. The insert could have a surface that is specular or diffusive. A diffusive insert could be made of highly reflective white plastic for example. Either or both of the reflective insert and the distribution optical medium could be made thermally conductive to aid in cooling the electronics in the base of the bulb. As an example, incorporating a thermally conductive additive into translucent plastic material can produce thermally conductive plastic.

Figure 5:
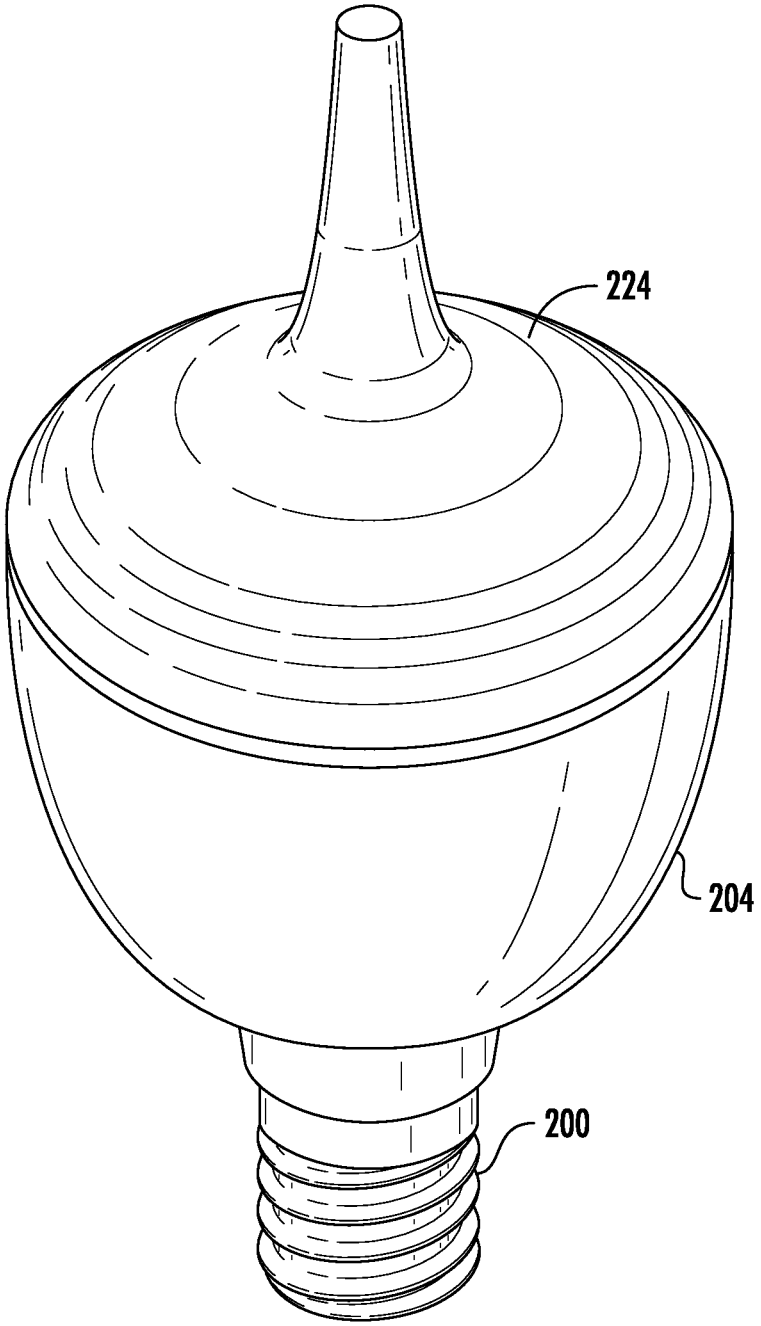
FIG. 5 is a perspective view of the solid-state candelabra lamp of FIGS. 2, 3, and 4, in which the optical dome has been removed, so that the guide optic can be clearly observed.

FIG. 5 is a perspective view of the entire base of the candelabra lamp of FIGS. 2, 3, and 4 so that the overall shape of the guide optic 224 in this example embodiment is visible. Note that in this case substantially all light conducted into the distribution optic is supplied by the guide optic. The optical dome or "optically transmissive enclosure" can be fastened with adhesive or fasteners on top of the guide optic, and can be designed so that the edges that rest on the guide optic are angled and are either light transmissive or opaque. If the edges of the dome are light transmissive the dome may be indirectly transmissively coupled into the distribution optic. It is possible to design the distribution optic so that the optically transmissive enclosure also or alternatively directly pipes light into the distribution optic and such an embodiment is described below with respect to FIG. 6.

LED device package 214 as shown in the figures can include a single LED, but more typically includes multiple LED chips or "LEDs" on a submount. Such a device is often referred to as an "LED" even if it in fact includes multiple LED chips. These can be so-called "flip-chip" LEDs or have a more conventional design with wire bonds making some or all electrical connections. Some or all of the LED chips can include a conformal phosphor layer. Alternatively, a lens or clear cover for the device package can include a phosphor layer. In some example embodiments, the phosphor layer's thickness is less than half the spacing between adjacent die. The combination of LEDs and phosphor are designed to emit substantially white light, or light with a color temperature similar to that of incandescent bulbs as might be desired. A submount in the device is typically covered with a pattern of metal to interconnect the LEDs if necessary and provide a connection to the power supply. Other components, such as ESD protection diodes may be present on the submount. Submounts for such devices may be made of alumina, aluminum nitride, or other materials, for example high-temperature polymers.

Figure 6:
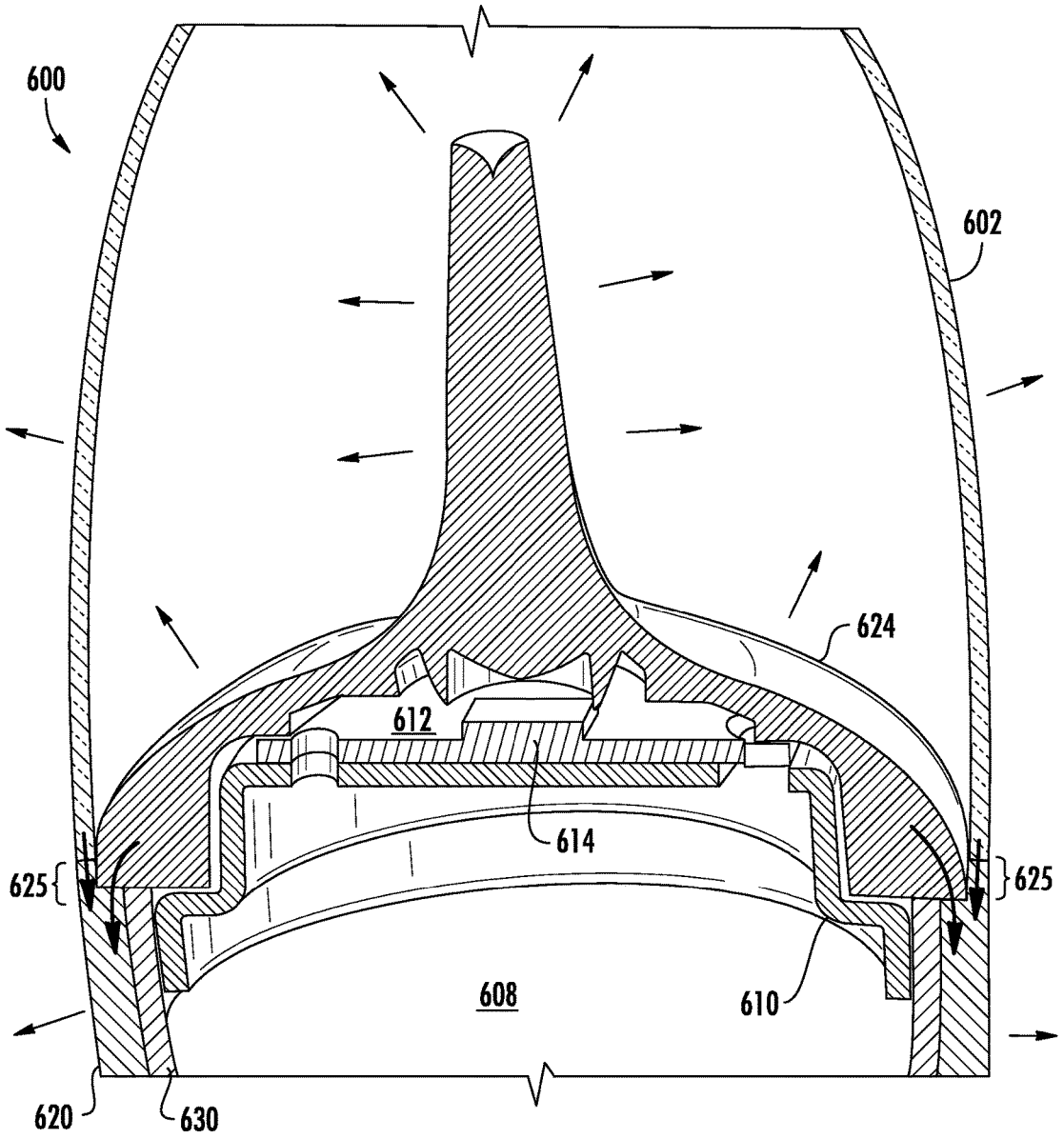
FIG. 6 is an enlarged cut-away, perspective view of the base of a candelabra lamp according to additional example embodiments of the invention.

FIG. 6 is a cut-away, magnified side view of an LED replacement bulb or lamp 600 according to additional example embodiments of the invention. Lamp 600 is again dimensioned as a replacement for a candelabra-style incandescent bulb and includes optically transmissive enclosure 602 and a driver base with an Edison-type screw connector (not shown). The arrows emanating from the bulb and guide optic 624 indicate the emission of light. Again, light is emitted from the driver base along with the light from the optically transmissive enclosure 602. Thus, when viewed at a distance, LED lamp 600 again gives off light in substantially all directions in the vertical plane, and thus looks like a traditional incandescent candelabra bulb.

Still referring to FIG. 6, the base of bulb 600 includes support 610 and circuit board 612, on which an LED device package 614 is mounted. Bulb 600 includes a distribution optic 620, again conformably disposed in or on the base. This distribution optic again can be translucent or transparent, and can be formed from an optical medium such as rigid plastic or a material that is sprayed, molded in place, or otherwise similarly applied to the base. In example embodiments the optical medium, regardless of the material can be on average, from 1 mm to 5 mm thick, and is conforming to the general shape of the base. However, note that in this case, the distribution optic has a step 625, in or on which both the guide optic 624 and the optical dome or transmissive enclosure 602 rest. That is, the guide optic 624 is arranged to direct light from the LED device package into the distribution optic, as indicated by the arrows from the guide optic to the distribution optic, but the enclosure 602 is also arranged to direct light from the LED device package into the distribution optic, as indicated by the arrows from the optically transmissive enclosure 602 to the distribution optic. Light then emanates from the distribution optic around the base of the bulb, in addition to from transmissive enclosure 602, resulting in a natural, pleasing light pattern, especially for a candelabra bulb, which would often be installed in an open or transparent fixture.

Continuing with FIG. 6, guide optic 624 in this example embodiment is again a total-internal-reflection (TIR) optic, but the base of the guide optic may have a smaller diameter to allow space for the stop and the optically transmissive enclosure. The vertical part of guide optic 624 in this example embodiment is again tapered, and includes similar internally reflective surfaces as previously described. It should be noted that the guide optic can be made even smaller and not couple any light into the distribution optic. In such a case, the optically transmissive enclosure couples light into the distribution optic exclusively or almost exclusively. One of skill in the art can alter the size of step 625 or the width of the various edges to achieve balance between light piping mechanism as required or desired for a particular bulb design.

As before, lamp 600 of FIG. 6 can include a reflective insert 630 installed between the distribution optic and the power supply. In some embodiments this insert is made of aluminum; however other materials could be used. The insert could have a surface that is specular or diffusive. A diffusive insert could be made of highly reflective white plastic for example. Again, either or both of the reflective insert and the distribution optical medium could be made thermally conductive to aid in cooling the electronics in the base of the bulb.

Figure 7:
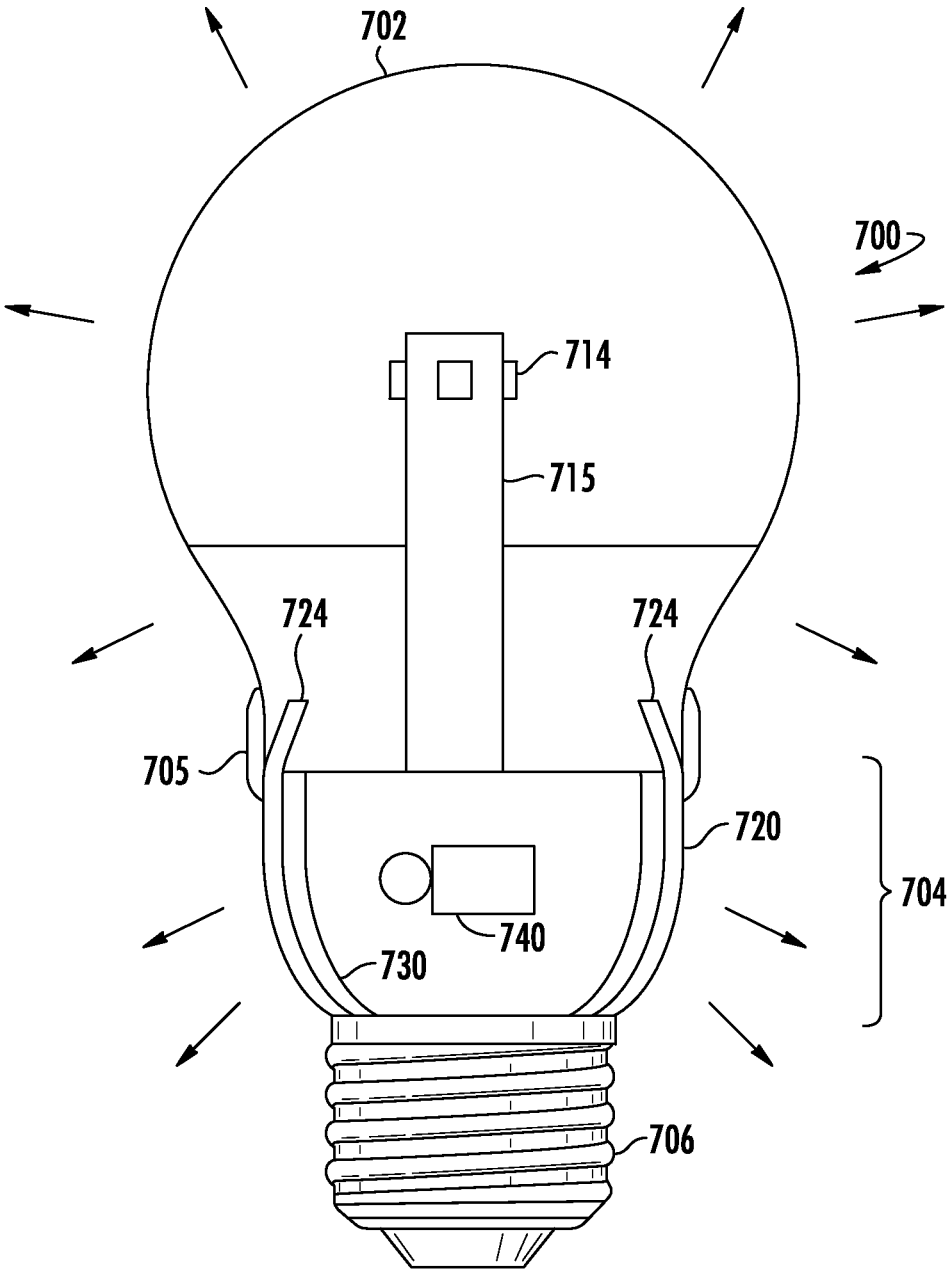
FIG. 7 is a cut-away side view of a A-series solid-state lamp according to further additional embodiments of the invention.

FIG. 7 is a cut-away side view of an A-series style SSL replacement lamp 700 that makes use of an embodiment of the invention. Lamp 700 includes transmissive enclosure or dome 702 and driver base 704, with Edison screw connector 706. This particular style of lamp includes a heatsink having fins 705. In this particular example embodiment, the guide optic does not need to direct light into the interior of the optical enclosure because LED devices 714 are located on filament tower 715 and provide properly distributed light within the optical enclosure. In this example embodiment, distribution optic 720 again can be translucent or transparent, and can be formed from an optical medium such as rigid plastic or a material that is sprayed, molded in place, or otherwise similarly applied to the base. Again, arrows emanating from the bulb indicate the emission of light. In example embodiments the optical medium, regardless of the material can be on average, from 1 mm to 5 mm thick, and is again conforming to the general shape of the base. Also in this example embodiment, guide optic 724 pipes light into the distribution optic. In this example, guide optic 724 is an annular light pipe.

Still referring to FIG. 7, lamp 700 again can include a reflective insert 730 installed between the distribution optic and the power supply 740. In some embodiments this insert is made of aluminum; however other materials could be used. The insert could have a surface that is specular or diffusive. A diffusive insert could be made of highly reflective white plastic for example. Again, either or both of the reflective insert and the distribution optical medium could be made thermally conductive to aid in cooling the electronics in the base of the bulb.

A lamp according to any of the above or other embodiments can be assembled by assembling a power supply within the base of the LED lamp, connecting an LED or LEDs to the power supply, connecting an optically transmissive enclosure to the base of the LED lamp to enclose the at least one LED, and installing a distribution optic in or on the base so as to serve as a light pipe by conducting light from the at least one LED for angularly distributed emission from the base of the LED lamp. As part of connecting the LED to the power supply, appropriate supports and circuit boards as previously described can be installed and connected. The various portions of a solid-state lamp or lighting system according to example embodiments of the invention can be made of any of various materials. Heatsinks can be made of metal or plastic, as can the various portions of the housings for the components of a lamp. A system according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

at least one LED;

an optically transmissive enclosure for the at least one LED;

a base;

a distribution optic conformably disposed in or on the base to conduct light from the at least one LED for angularly distributed emission from the base of the lamp; and a guide optic arranged to direct light from the at least one LED into the distribution optic.

2. The lamp of claim 1 wherein the optically transmissive enclosure is transmissively coupled to the distribution optic.

3. The lamp of claim 1 wherein the guide optic also directs light to the interior of the optically transmissive enclosure.

4. The lamp of claim 1 wherein both the guide optic and the optically transmissive enclosure are transmissively coupled to the distribution optic.

5. The lamp of claim 1 wherein the base further comprises a power supply.

6. The lamp of claim 5 further comprising a reflective insert between the distribution optic and the power supply.

7. The lamp of claim 5 wherein the distribution optic further comprises thermally conductive plastic.

8. The lamp of claim 1 dimensioned as a replacement for a candelabra type incandescent bulb.

9. The lamp of claim 1 dimensioned as a replacement for an A-series incandescent bulb.

10. A method of assembling an LED lamp, the method comprising:

assembling a power supply within or conforming to a base of the LED lamp;

connecting at least one LED to the power supply;

connecting an optically transmissive enclosure to the base of the LED lamp to enclose the at least one LED;

installing a distribution optic in or on the base so as to conduct light from the at least one LED for angularly distributed emission from the base of the LED lamp; and installing a guide optic to direct light from the at least one LED into the distribution optic.

11. The method of claim 10 further comprising installing a reflective insert between the distribution optic and the power supply.

12. The method of claim 11 further comprising forming the distribution optic from thermally conductive plastic.

13. A candelabra lamp comprising:

an optically transmissive enclosure;

at least one LED disposed in the optically transmissive enclosure;

a driver base connected to the optically transmissive enclosure and to the at least one LED;

an optical medium having a thickness from about 1 mm to about 5 mm, the optical medium substantially conforming to the driver base and receiving light from the at least one LED to provide angularly distributed emission from the driver base; and a TIR optic that directs light into the optically transmissive enclosure.

14. The candelabra lamp of claim 13 wherein the TIR optic is transmissively coupled to the optical medium.

15. The candelabra lamp of claim 13 wherein the optically transmissive enclosure is transmissively coupled to the optical medium.

16. The candelabra lamp of claim 13 wherein the TIR optic and the optically transmissive enclosure are both transmissively coupled to the optical medium.

17. The candelabra lamp of claim 13 further comprising a reflective insert disposed between the optical medium and the driver base.

18. The candelabra lamp of claim 13 wherein the optical medium is thermally conductive.

19. The candelabra lamp of claim 18 wherein the optical medium further comprises a thermally conductive additive.

20. An LED candelabra lamp comprising:

a driver base;

an optical dome connected to the driver base;

a power supply in the driver base; and a reflective insert between the distribution optic and the power supply;

wherein when viewed at a distance, the LED candelabra lamp gives of light in substantially all directions in the vertical plane to give the appearance of a traditional, incandescent candelabra bulb.

21. The LED candelabra lamp of claim 20 further comprising a distribution optic conformably disposed in or on the driver base to conduct light from at least one LED for angularly distributed emission from the driver base.

22. A lamp comprising:

at least one LED;

an optically transmissive enclosure for the at least one LED;

a base;

a distribution optic conformably disposed in or on the base to conduct light from the at least one LED for angularly distributed emission from the base of the lamp; and a support between the at least one LED and the base with the distribution optic.

23. The lamp of claim 22 wherein the base further comprises a power supply.

24. The lamp of claim 23 further comprising a reflective insert between the distribution optic and the power supply.

25. The lamp of claim 23 wherein the distribution optic further comprises thermally conductive plastic.

26. The lamp of claim 22 dimensioned as a replacement for a candelabra type incandescent bulb.

27. A candelabra lamp comprising:

an optically transmissive enclosure;

at least one LED disposed in the optically transmissive enclosure;

a driver base connected to the optically transmissive enclosure and to the at least one LED; and an optical medium having a thickness from about 1 mm to about 5 mm, the optical medium substantially conforming to the driver base and indirectly receiving light from the at least one LED to provide angularly distributed emission from the driver base.

28. The candelabra lamp of claim 27 wherein the optically transmissive enclosure is transmissively coupled to the optical medium.

29. The candelabra lamp of claim 27 further comprising a reflective insert disposed between the optical medium and the driver base.

30. The candelabra lamp of claim 27 wherein the optical medium is thermally conductive.

31. The candelabra lamp of claim 30 wherein the optical medium further comprises a thermally conductive additive.

* * * * *